US011089927B1

(12) United States Patent
Neill

(10) Patent No.: US 11,089,927 B1
(45) Date of Patent: Aug. 17, 2021

(54) BRUSHLESS VACUUM DEVICE

(71) Applicant: Awesome Things That Work, LLC, Chapel Hill, NC (US)

(72) Inventor: Joseph C. Neill, North Bend, OR (US)

(73) Assignee: Awesome Things That Work, LLC, Chapel Hill, NC (US)

( * ) Notice: Subject to any disclaimer, the term of this patent is extended or adjusted under 35 U.S.C. 154(b) by 0 days.

(21) Appl. No.: 17/114,090

(22) Filed: Dec. 7, 2020

(51) Int. Cl.
*A47L 9/08* (2006.01)
*A47L 13/16* (2006.01)

(52) U.S. Cl.
CPC ..... *A47L 9/08* (2013.01); *A47L 13/16* (2013.01)

(58) Field of Classification Search
CPC ..... A47L 9/08; A47L 13/16
See application file for complete search history.

(56) References Cited

U.S. PATENT DOCUMENTS 868,901 A * 10/1907 Williams ..... A47L 9/08 15/345
1,383,456 A * 7/1921 Farnsworth ..... A47L 9/08 15/346
2,181,487 A * 11/1939 Khuen-Kryk ..... A47L 9/08 15/345
3,268,942 A * 8/1966 Rossnan ..... A47L 9/08 15/346
3,678,534 A * 7/1972 Hilbig ..... A47L 9/02 15/345
3,694,848 A * 10/1972 Alcala ..... A47L 5/14 15/346
4,018,483 A * 4/1977 Smith ..... A47L 9/08 406/108
4,300,261 A * 11/1981 Woodward ..... A47L 9/08 15/345
4,352,251 A 10/1982 Sloan
4,884,315 A * 12/1989 Ehnert ..... A47L 5/14 15/346
5,613,269 A * 3/1997 Miwa ..... A47L 5/14 15/319

(Continued)

FOREIGN PATENT DOCUMENTS

CH 692970 A5 * 1/2003 ..... A47L 9/02
DE 678723 C * 7/1939 ..... A47L 9/08

(Continued)

*Primary Examiner* — Marc Carlson
(74) *Attorney, Agent, or Firm* — Patentfile, LLC; Bradley C. Fach; Steven R. Kick

(57) ABSTRACT

A brushless vacuum device may include a vacuum head having a bottom side, a first and second exterior wall, a front end, and a back end. The first exterior wall and second exterior wall may be positioned on the bottom side and may be coupled together at the front end. A suction aperture may be positioned proximate to the front end. A first plurality of jets may extend along the first exterior wall between the suction aperture and the back end. A second plurality of jets may extend along the second exterior wall between the suction aperture and the back end. A suction conduit may be in communication with the suction aperture and may generate negative air pressure in the suction aperture. A pressure conduit may generate a positive air pressure in the first plurality and second plurality of jets. Air exiting the jets may be collected by the suction aperture.

19 Claims, 6 Drawing Sheets

(56) References Cited

U.S. PATENT DOCUMENTS 5,647,092 A * 7/1997 Miwa ..... A47L 5/14 15/346
5,887,667 A 3/1999 Zante et al.
6,052,861 A * 4/2000 Keller ..... A47L 9/02 15/321
6,173,473 B1 * 1/2001 Miwa ..... A47L 9/02 15/345
6,449,799 B1 * 9/2002 Keller ..... A47L 9/02 15/322
7,458,130 B1 * 12/2008 Krymsky ..... A47L 5/14 15/345
7,555,812 B1 7/2009 Pinney
7,591,088 B1 9/2009 Schuh et al.
2002/0053115 A1 * 5/2002 Deng ..... A47L 9/08 15/346
2002/0148069 A1 * 10/2002 Illingworth ..... A47L 9/08 15/346
2004/0134024 A1 * 7/2004 Allen ..... A47L 7/0009 15/381
2005/0217065 A1 * 10/2005 Allen ..... A47L 5/14 15/346
2006/0213025 A1 * 9/2006 Sawalski ..... A47L 9/322 15/344
2007/0039123 A1 * 2/2007 Bird ..... A47L 5/14 15/345
2007/0180650 A1 * 8/2007 Gabara ..... A47L 9/08 15/345
2010/0101044 A1 * 4/2010 Salmond ..... A47L 9/08 15/363
2012/0260454 A1 * 10/2012 Lester ..... A47L 9/08 15/327.1
2013/0326842 A1 * 12/2013 Pearson ..... A47L 9/02 15/415.1
2014/0289997 A1 * 10/2014 Marshall ..... A47L 9/08 15/339
2018/0310787 A1 * 11/2018 Royce ..... A47L 5/14

FOREIGN PATENT DOCUMENTS

DE 1728280 A1 * 2/1972 ..... A47L 9/08
DE 7609105 U1 * 9/1977 ..... A47L 9/08
DE 202011105882 U1 * 11/2011 ..... F04D 29/701
DE 102016113639 A1 * 2/2018 ..... A47L 5/14
GB 786179 A * 11/1957 ..... A47L 9/08
GB 786180 A * 11/1957 ..... A47L 9/08
WO WO-8605962 A1 * 10/1986 ..... B08B 5/00
WO WO-0019881 A1 * 4/2000 ..... A47L 9/1608
WO WO-0069320 A1 * 11/2000 ..... A47L 5/34

* cited by examiner

BRUSHLESS VACUUM DEVICE

FIELD OF THE INVENTION

This patent specification relates to the field of cleaning devices. More specifically, this patent specification relates to a brushless cleaning device that simultaneously uses positive pressure and negative pressure fluids, such as air, to both loosen and remove contaminants from surfaces.

BACKGROUND

Vacuum cleaners often use a spinning brush to disturb the dirt on carpeting so the vacuum cleaner can capture it. However, the spinning brush tangles long fibers hurting performance and requiring high maintenance. Also, the spinning brush can be damaging to electrical cords, carpet fringe or shoe laces. On hard surfaces a spinning brush can throw out dense objects before the vacuum can capture them. A further drawback common to these vacuum cleaners is that the spinning brush can increase the amount of effort that a user must exert to move the device, such as when the user moves the vacuum cleaner in against the direction of spin of the brush.

These problems have been attempted to be addressed by some vacuum cleaner that provide the ability of turning off the brush roll with additional motors switches or levers and idler pulleys. When the brush is off the performance is impaired due to the large opening to accommodate the brush roll. This larger opening is greater than the optimum volume and suction for a turbine fan motor. Some vacuum cleaners have addressed this with a channel next to the brush roll. This "Wind tunnel" is prone to plugging with long fibers as found in longer carpets. An alternative to clean multiple surfaces is two motors using a radial fan for high volume cleaning, like carpeting, and a turbine fan for high suction on tools. The radial fan is subject to fan breakage and an extra expense. Nor does the multiple motors address the inherent problems with the spinning brush.

Therefore, a need exists for novel cleaning devices. A further need exists for novel vacuum cleaning devices that do not require a spinning brush to agitate contaminants from objects, such as carpet. There is also a need for novel brushless cleaning devices that require minimal effort by a user when maneuvering the devices while cleaning.

BRIEF SUMMARY OF THE INVENTION

A brushless vacuum device is provided. Generally, the device may be configured to provide an easy to use, more efficient dustless vacuum cleaner without the limits of a spinning brushroll that is able to gently handle multiple surfaces and debris especially very long fibers. Additionally, the vacuum head of the device easily moves in any direction while using the properties of a ground effect device that may be provided by the positive pressure air exiting the jets, to levitate it.

In some embodiments, the device may include a vacuum head having a top surface and an opposing bottom side, a first exterior wall, a second exterior wall, a front end, and a back end. The first exterior wall and second exterior wall may be positioned on the bottom side and may be coupled together at the front end. A suction aperture may be disposed in the vacuum head on the bottom side and preferably positioned proximate to where the first exterior wall and second exterior wall may be coupled together. A first plurality of jets may be coupled to the vacuum head on the bottom side, and the first plurality of jets may extend along the first exterior wall between the suction aperture and the back end. A second plurality of jets may also be coupled to the vacuum head on the bottom side, and the second plurality of jets may extend along the second exterior wall between the suction aperture and the back end. A suction conduit may be coupled to the vacuum head and may be in communication with the suction aperture. The suction conduit may generate negative air pressure in the suction aperture. A pressure conduit may also be coupled to the vacuum head and may be in communication with the first plurality and second plurality of jets. The pressure conduit may generate a positive air pressure in the first plurality and second plurality of jets. Air flow may generally enter the vacuum head through a pressure conduit, pass through a pressure duct, pass through apertures to be drawn up through a suction aperture, pass through a suction duct, and exit the vacuum head via a suction conduit.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
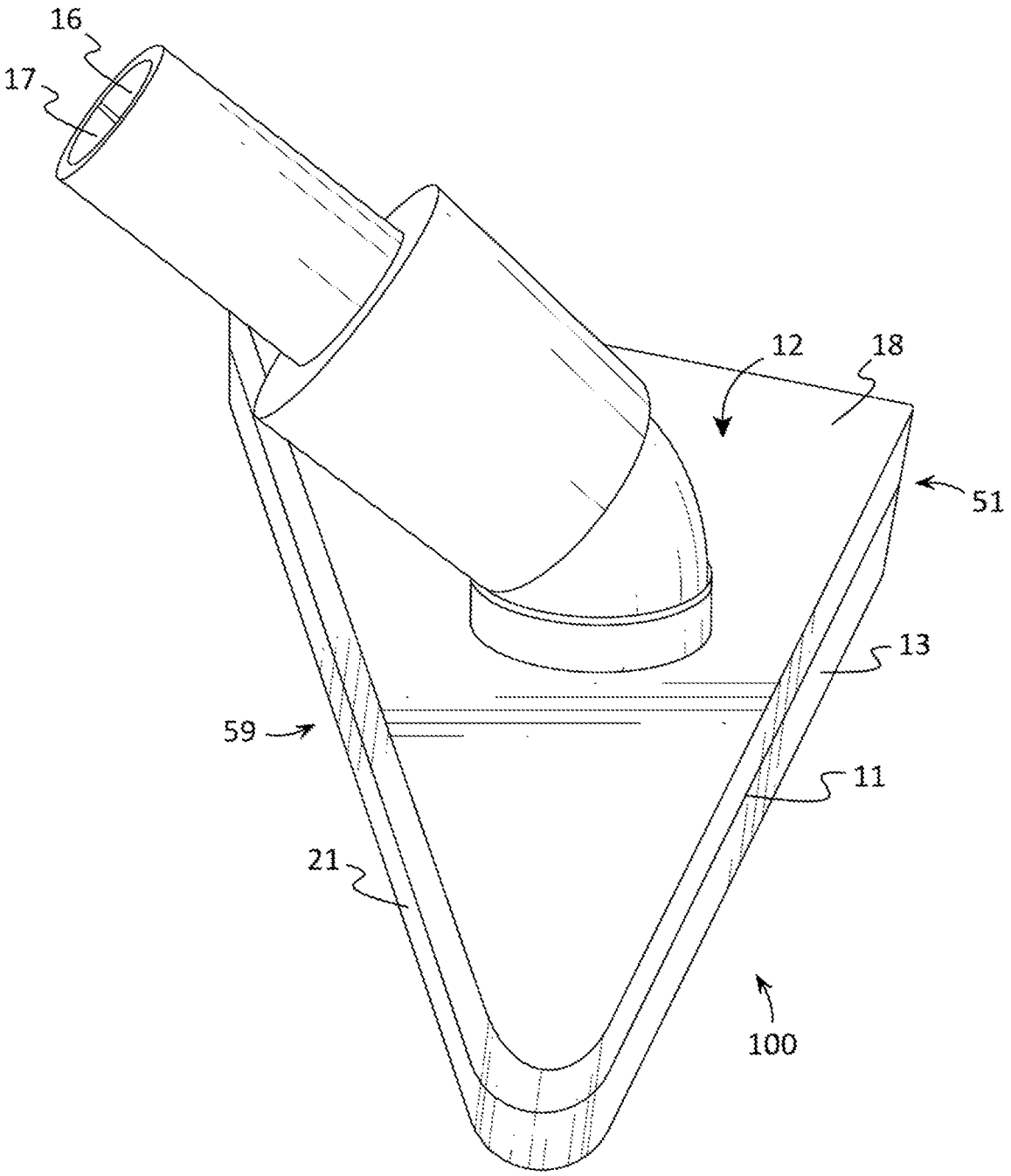
FIG. 1—FIG. 1 depicts a top perspective view of an example of a brushless vacuum device according to various embodiments described herein.
Figure 2:
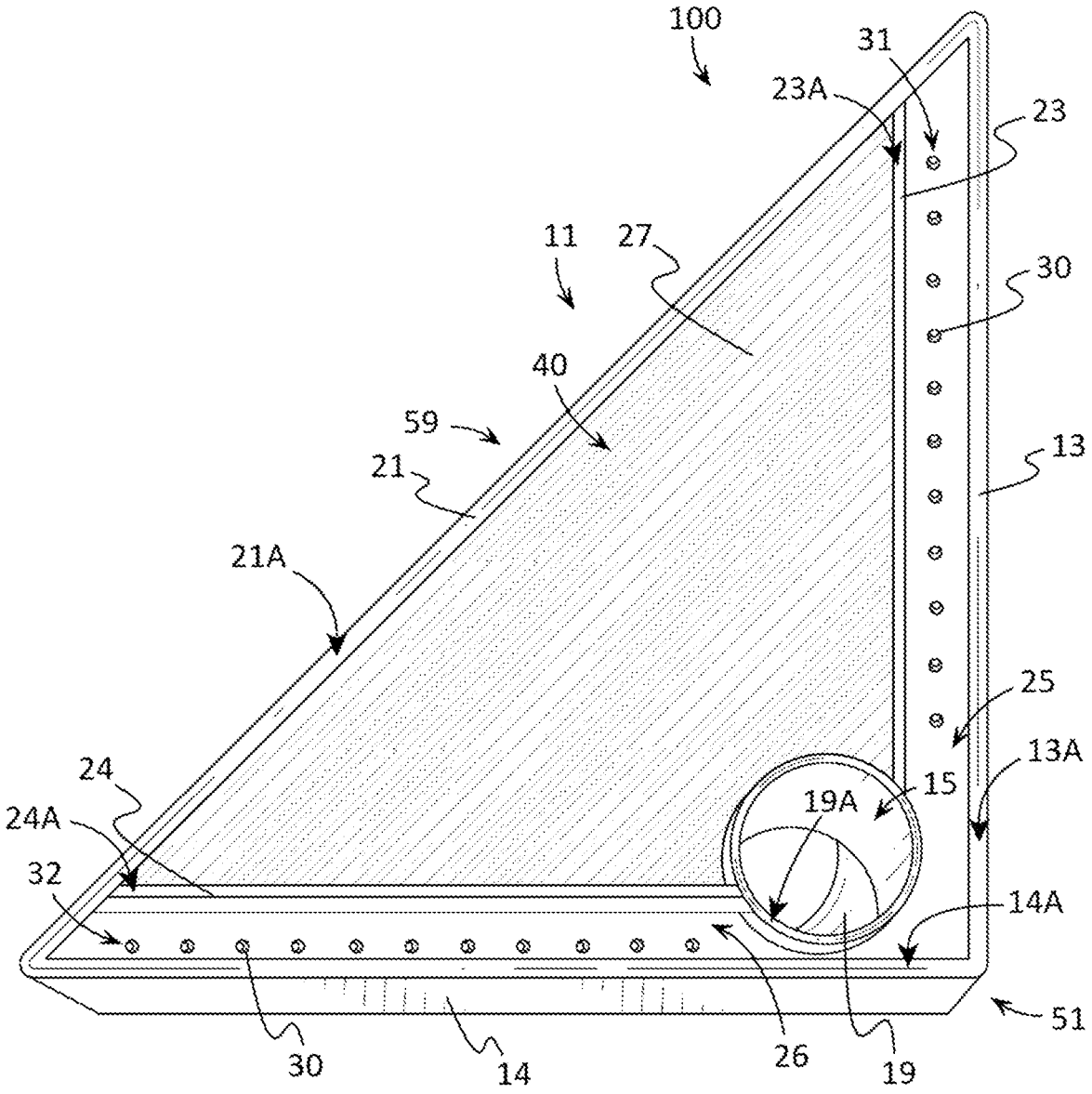
FIG. 2—FIG. 2 illustrates a bottom perspective view of another example of a brushless vacuum device according to various embodiments described herein.
Figure 3:
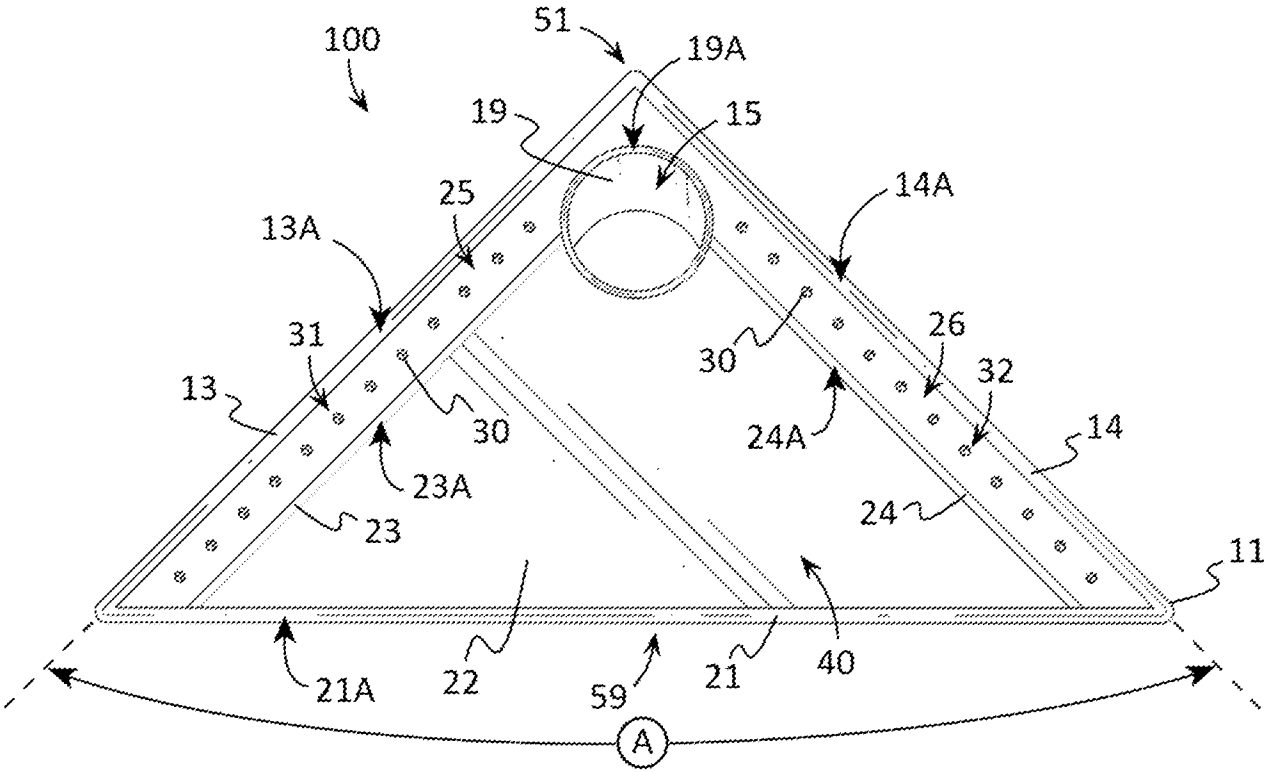
FIG. 3—FIG. 3 shows a bottom perspective view of a further example of a brushless vacuum device according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new brushless vacuum device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-5 illustrate examples of a brushless vacuum device ("the device") 100 according to various embodiments. In some embodiments, the device 100 may comprise a vacuum head 11 having a top surface 12 and an opposing bottom side 40, a first exterior wall 13, a second exterior wall 14, a front end 51, and a back end 59. The first exterior wall 13 and second exterior wall 14 may be positioned on the bottom side 40 and may be coupled together at the front end 51. A suction aperture 15 may be disposed in the vacuum head 11 on the bottom side 40 and preferably positioned proximate to where the first exterior wall 13 and second exterior wall 14 may be coupled together. A first plurality of jets 31 may be coupled to the vacuum head 11 on the bottom side 40, and the first plurality of jets 31 may extend along the first exterior wall 13 between the suction aperture 15 and the back end 59. A second plurality of jets 32 may be coupled to the vacuum head 11 on the bottom side 40, and the second plurality of jets 32 may extend along the second exterior wall 14 between the suction aperture 15 and the back end 59. A suction conduit 16 may be coupled to the vacuum head 11 and may be in communication with the suction aperture 15. The suction conduit 16 may generate negative air pressure in the suction aperture 15. A pressure conduit 17 may also be coupled to the vacuum head 11 and may be in communication with the first plurality 31 and second plurality 32 of jets. The pressure conduit 17 may generate a positive air pressure in the first plurality 31 and second plurality 32 of jets. Air flow (shown by arrows 200 in FIG. 4) may generally enter the vacuum head 11 through a pressure conduit 17, pass through a pressure duct 20, pass through apertures 30 to be drawn up through a suction aperture 15, pass through a suction duct 19, and exit the vacuum head 11 via a suction conduit 16. Generally, the device 100 may be configured to provide an easy to use, more efficient dustless vacuum cleaner without the limits of a spinning brushroll that is able to gently handle multiple surfaces and debris especially very long fibers. Additionally, the vacuum head 11 easily moves in any direction while using the properties of a ground effect device that may be provided by the positive pressure air exiting the jets 30, to levitate it.

The device 100 may comprise a vacuum head 11 which may be manipulated by a user and used to direct positive pressure fluid flow and negative pressure fluid flow preferably for cleaning purposes. In preferred embodiments, a vacuum head 11 may direct positive pressure and negative pressure air to both loosen and remove contaminants from surfaces. In further embodiments, a vacuum head 11 may direct one or more positive pressure and negative pressure fluids, such as water, aqueous solutions, non-aqueous liquids, organic liquids, inorganic liquids, gases, etc., to both loosen and remove contaminants from surfaces.

A vacuum head 11 may be configured in any size and shape. In preferred embodiments, a vacuum head 11 may generally have a top surface 12, which may be formed by a top wall 18, and an opposing bottom side 40. A vacuum head 11 may also comprise a bottom wall 22 which may be positioned on the bottom side 40 generally opposite to the top wall 18. In use, the top surface 12 may face a user and the bottom side 40 may be place on or over a surface, such as for cleaning purposes. A top wall 18 may be configured in any size and shape to form a top surface 12 of any size and shape. In some embodiments, a suction conduit 15 and/or a pressure conduit 17 may be coupled to the top wall 18 anywhere on its top surface 12. In preferred embodiments, a suction conduit 15 and/or a pressure conduit 17 may be coupled to the top wall 18 and positioned centrally on top surface 12 to provide better balance of the vacuum head 11.

A vacuum head 11 may comprise a first exterior wall 13 and a second exterior wall 14 which may be positioned on the bottom side 40. In preferred embodiments, a first exterior wall 13 and a second exterior wall 14 may be coupled to the top wall 18 and may form portions of the vacuum head 11 that separate the top wall 18 from elements that are positioned on the bottom side 40. A vacuum head 11 may also generally comprise a front end 51 and a back end 59.

Generally, a first exterior wall 13 and a second exterior wall 14 may be coupled together or positioned to be most proximate to each other at or proximate to the front end 51. Preferably, a first exterior wall 13 and a second exterior wall 14 may positioned to be most distant from each other at or proximate to the back end 59.

The exterior walls 13, 14, may form the portions of the device 100 that extend the farthest away from the vacuum head 11, and the exterior walls 13, 14, may be configured in any size and shape. For example, the exterior walls 13, 14, may be generally planar shape as they extend from the front end 51 to the back end 59. As another example, the exterior walls 13, 14, may be generally curved in shape, such as convex or concave curved as they extend from the front end 51 to the back end 59. In some embodiments, the exterior walls 13, 14, may be generally planar shape, and the first exterior wall 13 and second exterior wall 14 may be angled relative to each other between approximately 92 degrees and 30 degrees as shown by Angle A in FIG. 3. In preferred embodiments, the exterior walls 13, 14, may be generally planar shape, and the first exterior wall 13 and second exterior wall 14 may be angled relative to each other between approximately 90 degrees and 85 degrees (Angle A being between approximately 90 degrees and 85 degrees. In further preferred embodiments, the device 100 may comprise interior walls 23, 24, that may be generally planar shape and which may be generally parallel to their respective most proximate exterior wall 13, 14, so that the interior walls 23, 24, may be angled relative to each other between approximately 92 degrees and 30, and more preferably between approximately 90 degrees and 85 degrees.

In some embodiments, an exterior wall 13, 14, may be substantially rigid, such as by being made of hard plastic, such as poly-vinyl chloride (PVC), polypropylene (PP), nylon, etc., fiberglass, metal, or other structural material. In further embodiments, all or portions of an exterior wall 13, 14, may be substantially flexible, such as by being made from or comprising a plurality of bristles, a flexible material, such as cloth, flexible plastic, such as LDPE (low density polyethylene), silicone rubber, etc.

A first exterior wall 13 may comprise a first exterior surface 13A, and a second exterior wall 14 may comprise a second exterior surface 14A. The exterior surfaces 13A, 14A, may form the portions of the exterior walls 13, 14, that extend the farthest away from the vacuum head 11. In preferred embodiments, one or both exterior surfaces 13A, 14A, may be generally flat or level. In further embodiments, one or both exterior surfaces 13A, 14A, may be textured.

The device 100 may comprise one or more suction apertures 15 which may be disposed anywhere on the bottom side 40 of a vacuum head 11. A suction aperture 15 may be in communication with a suction conduit 16 so that the suction conduit 16 may generate negative fluid pressure, such as negative air pressure, in the suction aperture 15. Optionally, a suction duct 19 may be formed in the vacuum head 11, and the suction duct 19 may communicate negative pressure from where the suction conduit 16 is coupled to the vacuum head 11 to the suction aperture 15. A suction duct 19 may comprise a duct terminal surface 19A which may be formed by a portion of the suction duct 19 that extends away from the vacuum head 11 on the bottom side 40. Generally, a duct terminal surface 19A may extend away from the vacuum head 11 a lesser distance than the exterior surfaces 13A, 14A.

A duct terminal surface 19A may form a suction aperture 15, and a suction aperture 15 may be configured in any size and shape. Preferably, a suction aperture 15 may be disposed on the bottom side 40 of the vacuum head 11 and positioned proximate to where the first exterior wall 13 and second exterior wall 14 are coupled together at the front end 51. More preferably, a suction aperture 15 may be coupled to the first exterior wall 13 and second exterior wall 14.

The device 100 may comprise one or more jets 30 which may be disposed anywhere on the bottom side 40 of a vacuum head 11. Each jet 30 may be in communication with a pressure conduit 17 so that the pressure conduit 17 may generate positive fluid pressure, such as positive air pressure, in each jet 30. The device 100 may comprise one or more pressure ducts 20 which may be formed in the vacuum head 11, and the pressure ducts 20 may communicate positive pressure from where a pressure conduit 17 is coupled to the vacuum head 11 to one or more of the jets 30.

A jet 30 may be configured in any size and shape. Preferably, the jets 30 may be disposed on the bottom side 40 of the vacuum head 11 and positioned anywhere between the first exterior wall 13 and second exterior wall 14. More preferably, one or more jets 30 may be coupled proximate to the first exterior wall 13 and second exterior wall 14. Generally, the jets 30 may constrict and direct the fluid, such as air, that flows through them from a pressure duct 20 to the bottom side of the vacuum head 11.

In some embodiments, one or more jets 30 may direct the fluid flowing through them to be approximately perpendicular, such as approximately straight down, to a surface that the vacuum head 11 may be used to clean. In preferred embodiments, one or more jets 30 may direct the fluid flowing through them to be angled towards the suction aperture(s) 15 as shown by Angle B in FIG. 4. For example, a first jet 30 that may be positioned relatively closer to a suction aperture 15 may be slightly angled towards the suction aperture 15, and a second jet 30 that may be positioned relatively farther from a suction aperture 15 may be more angled towards the suction aperture 15 than the first jet 30. In some embodiments, one or more jets 30 of a plurality of jets 31, 32, such as all jets 30 of a plurality of jets 31, 32, may be configured to direct the fluid flowing through them to be angled between 10 to 80 degrees towards a suction aperture 15 relative to an exterior surface 13A, 14A, (Angle B being between approximately 10 to 80 degrees). By having one or more jets 30 angled towards the suction aperture(s) 15 the jets 30 are able to force the dirt from the back of a channel 25, 26, to the suction aperture 15 in front so that they create a venturi effect and will propel dirt up the suction hose without any suction applied.

In preferred embodiments, one or more jets 30 may constrict the fluid that flows through them from a pressure duct 20 to the bottom side of the vacuum head 11. In some embodiments, a jet 30 may constrict the fluid that flows through it by having a jet aperture 30A (fluid exit point of a jet 30) that is smaller in cross section or other dimension than the cross section or other dimension of the pressure duct 20 that it is in communication with. In further embodiments, a jet 30 may the fluid that flows through it by having a constriction 30B that is smaller in cross section or other dimension than the cross section or other dimension of the pressure duct 20 that it is in communication with. A constriction 30B may comprise any narrowing of a portion of a jet 30 that the fluid flows through.

In preferred embodiments, the device 100 may comprise a first plurality of jets 31 that may be coupled or positioned on the bottom side 40 of the vacuum head 11, and the first plurality of j ets 31 may extend along the first exterior wall 13 between the suction aperture 15 and the back end 59. In further preferred embodiments, the device 100 may comprise a second plurality of jets 31 that may be coupled or positioned on the bottom side 40 of the vacuum head 11, and the second plurality of jets 32 may extend along the second exterior wall 14 between the suction aperture 15 and the back end 59. In further embodiments, one or more jets 30, such as all, of the first plurality of j ets 31 may be angled towards suction aperture 15 and/or one or more jets 30, such as all, of the second plurality of jets 32 may be angled towards suction aperture 15.

In some embodiments, a plurality of j ets 31, 32, may be configured so that the jets 30 of the plurality of jets 31, 32, are generally linearly aligned with each other and preferably aligned with a suction aperture 15. In further embodiments, a plurality of jets 31, 32, may be configured so that the jets 30 of the plurality of jets 31, 32, are arranged in any other orientation relative to each other and a suction aperture 15. For example, a first plurality of j ets 31 may comprise 2 or more rows of jets 30 with each row extending all or portions of the way between a suction aperture 15 and the back end 59.

In some embodiments, the device 100 may comprise one or more interior walls 23, 24, which may be coupled to the bottom side 40 of the vacuum head 11. An interior wall 23, 24, may be configured in any size and shape. An interior wall 23, 24, may be made from or comprise any suitable material, such as which may be used to form an exterior wall 13, 14, including substantially rigid materials, flexible materials, bristles, etc.

In some embodiments, the device 100 may comprise a first interior wall 23 which may be coupled to the to the bottom side 40 of the vacuum head 11 so that the first interior wall 23 is approximately parallel to the first exterior wall 13. Similar to a first exterior wall 13, a first interior wall 23 may be configured in any shape and size. In some embodiments, a first interior wall 23 may be coupled to or proximate to a suction aperture 15. In further embodiments, a first interior wall 23 may extend all or portions of the distance between the suction aperture 15 and the back end 59. A first interior wall 23 may comprise a first interior surface 23A which may form the portion of the first interior wall 23 that may extend the farthest away from the vacuum head 11. In preferred embodiments, a first interior surface 23A may be generally flat or level. In further embodiments, a first interior surface 23A may be textured.

In some embodiments, a first channel 25 may be formed between the first interior wall 23 and the first exterior wall 13. In further embodiments, the device 100 may comprise a first plurality of jets 31 which may be positioned between the first interior wall 23 and the first exterior wall 13, and the first plurality of jets 31 may be recessed into the vacuum head 11 relative to the first interior surface 23A of the first interior wall 23 and the first exterior surface 13A of the first exterior wall 13 by being positioned within the first channel 25. In preferred embodiments, one or more jets 30 of the first plurality of jets 31 may constrict air flowing from the pressure conduit 17 to between the first interior wall 23 and the first exterior wall 13 to generate a venturi effect. For example, a jet 30 of the first plurality of j ets 31 may constrict air flowing from the pressure conduit 17 to between the first interior wall 23 and the first exterior wall 13 to generate a first venturi effect.

In some embodiments, the device 100 may comprise a second interior wall 24 which may be coupled to the to the bottom side 40 of the vacuum head 11 so that the second interior wall 24 is approximately parallel to the second exterior wall 14. Similar to a second exterior wall 14, a second interior wall 24 may be configured in any shape and size. In some embodiments, a second interior wall 24 may be coupled to or proximate to a suction aperture 15. In further embodiments, a second interior wall 24 may extend all or portions of the distance between the suction aperture 15 and the back end 59. A second interior wall 24 may comprise a second interior surface 24A which may form the portion of the second interior wall 24 that may extend the farthest away from the vacuum head 11. In preferred embodiments, a second interior surface 24A may be generally flat or level. In further embodiments, a second interior surface 24A may be textured.

In some embodiments, a second channel 26 may be formed between the second interior wall 24 and the second exterior wall 14. In further embodiments, the device 100 may comprise a second plurality of jets 32 which may be positioned between the second interior wall 24 and the second exterior wall 14, and the second plurality of j ets 32 may be recessed into the vacuum head 11 relative to the second interior surface 24A of the second interior wall 24 and the second exterior surface 14A of the second exterior wall 14 by being positioned within the second channel 26. In preferred embodiments, one or more jets 30 of the second plurality of jets 32 may constrict air flowing from the pressure conduit 17 to between the second interior wall 24 and the second exterior wall 14 to generate a venturi effect. For example, a jet 30 of the second plurality of jets 32 may constrict air flowing from the pressure conduit 17 to between the second interior wall 24 and the second exterior wall 14 to generate a second venturi effect.

In some embodiments, the device 100 may comprise one or more rear walls 21 which may be coupled to the to the bottom side 40 of the vacuum head 11 so that the rear walls 21 may be positioned distally to a suction aperture 15. Similar to the other walls 13, 14, 23, 24, a rear wall 21 may be configured in any shape and size. A rear wall 21 may comprise a rear interior surface 21A which may form the portion of the rear wall 21 that may extend the farthest away from the vacuum head 11. In preferred embodiments, a rear interior surface 21A may be generally flat or level. In further embodiments, a rear interior surface 21A may be textured.

In some embodiments, the device 100 may comprise one or more rear walls 21 which may bound portions of one or more channels 25, 26, proximate to the back end 59. In preferred embodiments, the device 100 may comprise a rear wall 21 which may be coupled to the portions of the first exterior wall 13 and second exterior wall 14 that are most distal to the front end 51 and also coupled to the portions of the first interior wall 23 and second interior wall 24 that are most distal to the front end 51. In this manner a single rear wall 21 may bound portions of both channels 25, 26, proximate to the back end 59. In further embodiments, the device 100 may comprise a first rear wall 21 which may be coupled to the portions of the first exterior wall 13 and first interior wall 23, and the device 100 may also comprise a second rear wall 22 which may be coupled to the portions of the second exterior wall 14 and second interior wall 24 that are most distal to the front end 51. In this manner a single rear wall 21 may bound portions of a single channel 25, 26, proximate to the back end 59.

In some embodiments, the first exterior surface 13A, second exterior surface 14A, and the rear interior surface(s) 21A may extend substantially the same distance from the top surface 12 so that the surfaces 13A, 14A, 21A, are in substantially the same plane. This may allow the surfaces 13A, 14A, 21A, to function as an air dam so that approximately, and more preferably substantially, all of the air or other liquid passing through the jets 30 may be removed by the suction aperture(s) 15. In further embodiments, the first exterior surface 13A, second exterior surface 14A, first interior surface 23A, second interior surface 24A, and the rear interior surface(s) 21A may extend substantially the same distance from the top surface 12 so that the surfaces 13A, 14A, 23A, 24A, 21A, are in substantially the same plane. This may allow the surfaces 13A, 14A, 23A, 24A, 21A, to function as an air dam so that approximately, and more preferably substantially, all of the air or other liquid passing through the jets 30 may be removed by the suction aperture(s) 15.

In some embodiments, the device 100 may comprise one or more cleaning pads 27 that may be coupled to the bottom side 40 of the vacuum head 11, such as to portions of a bottom wall 22. A cleaning pad 27 may be configured in any shape and size. In preferred embodiments, a cleaning pad 27 may be sized and shaped so that the cleaning pad 27 may extend from a first interior wall 23 to a second interior wall 24 and also from portions of the suction duct 19 forming a suction aperture 15 to the back end 59, such as to a rear wall 21. In preferred embodiments, a cleaning pad 27 may be removably coupled between a first interior wall 23 and a second interior wall 24 via a hook-and-loop fastener, magnetic fastener, clip fastener, clasp fastener, or any other suitable removably coupling method or fastener.

A cleaning pad 27 may be made from any suitable cleaning material. In preferred embodiments, a cleaning pad 27 may be made from or may comprise a non-abrasive material, such as microfiber (or microfibre) that may be a synthetic fiber finer than one denier or decitex/thread, having a diameter of less than ten micrometers. The most common types of microfiber are made variously of polyesters; polyamides (e.g., nylon, Kevlar, Nomex, trogamide); and combinations of polyester, polyamide, and polypropylene, however any suitable material may be used. In further embodiments, a cleaning pad 27 may be made from or may comprise a non-abrasive material, such as synthetic fabrics such as polyester, acrylic, nylon, rayon, acetate, spandex, spandex blends, and Kevlar, and natural fabrics such as coir, cotton, hemp, jute, canvas, flax, leather, linen, ramie, wool, silk, or any other suitable flexible natural or synthetic material including combinations of materials. In still further embodiments, a cleaning pad 27 may be made from or may comprise a slightly abrasive material, such as Melamine foam, plastic fiber scouring pad material, etc.

In some embodiments, the device 100 may comprise a fluid motivation device 61 which may be configured to motivate one or more fluids, such as air, cleaning solutions, etc., through one or more elements of the device 100. In some embodiments, a fluid motivation device 61 may comprise a brushed DC motor, brushless DC motor, switched reluctance motor, universal motor, AC polyphase squirrel-cage or wound-rotor induction motor, AC SCIM split-phase capacitor-start motor, AC SCIM split-phase capacitor-run motor, AC SCIM split-phase auxiliary start winding motor, AC induction shaded-pole motor, wound-rotor synchronous motor, hysteresis motor, synchronous reluctance motor, pancake or axial rotor motor, stepper motor, or any other type of motor. In further embodiments, a fluid motivation device 61 may comprise a hydraulic motor such as a Gear and vane motor, Gerotor motor, Axial plunger motors, Radial piston motors, or any other hydraulically motivated motor. In still further embodiments, a fluid motivation device 61 may comprise a pneumatic motor, such as a linear pneumatic motor and a pneumatic rotary vane motor. Optionally, a fluid motivation device 61 may be provided power via a battery pack, such as a Lithium type of battery pack, or by an electrical cord, such as which may enable electronic communication with a power outlet.

A fluid motivation device 61 may be operatively coupled to an impeller 62 which may comprise the rotating part of a centrifugal pump, compressor, or other machine designed to move a fluid by rotation. An impeller 62 may comprise any device configured to cause, motivate, or direct air flow. An impeller 62 may include a rotating arrangement of vanes or blades capable of moving air, such as a rotary vane pump, a diaphragm pump, a piston pump, a scroll pump, a screw pump, a Wankel pump, an external vane pump, a roots blower or booster pump, a multistage roots pump, a blower fan, a vane pump, axial-flow fans, centrifugal fans, cross-flow fans, bellows, Coandă effect air movers, electrostatic air movers, or any other device or method capable of moving fluids such as air. In further embodiments, a fluid motivation device 61 and an impeller 62 may be configured as a three stage peripheral discharge motor.

In some embodiments, the device 100 may comprise a filter device 63 which may be configured to remove dirt and other contaminant matter from the fluid that is removed from the bottom side 40 of the vacuum head 11 via a suction aperture 15. In preferred embodiments, fluid that passes through the filter device 63 may be motivated through one or more of the jets 30. In this manner, air that is motivated through a suction conduit 15 may be recirculated through the first plurality 31 and second plurality of jets 32. A filter device 63 may comprise any type of device or method of removing dirt and other contaminant matter from a fluid, such as air. For example, a filter device 63 may comprise a cartridge filter, a cloth filter, a foam filter, disk filter. HEPA filter, MicroFresh filter, allergen filter, pet filter, Wet/dry filter, scented filter, ULPA filter, cyclone filter that sends the fluid stream through one or more cylinders, along a high-speed spiral path, etc.

In some embodiments, the device 100 may comprise a single fluid motivation device 61 which may operate a single impeller 62. In further embodiments, the device 100 may comprise one or more fluid motivation devices 61 which may operate one or more impellers 62.

Figure 4:
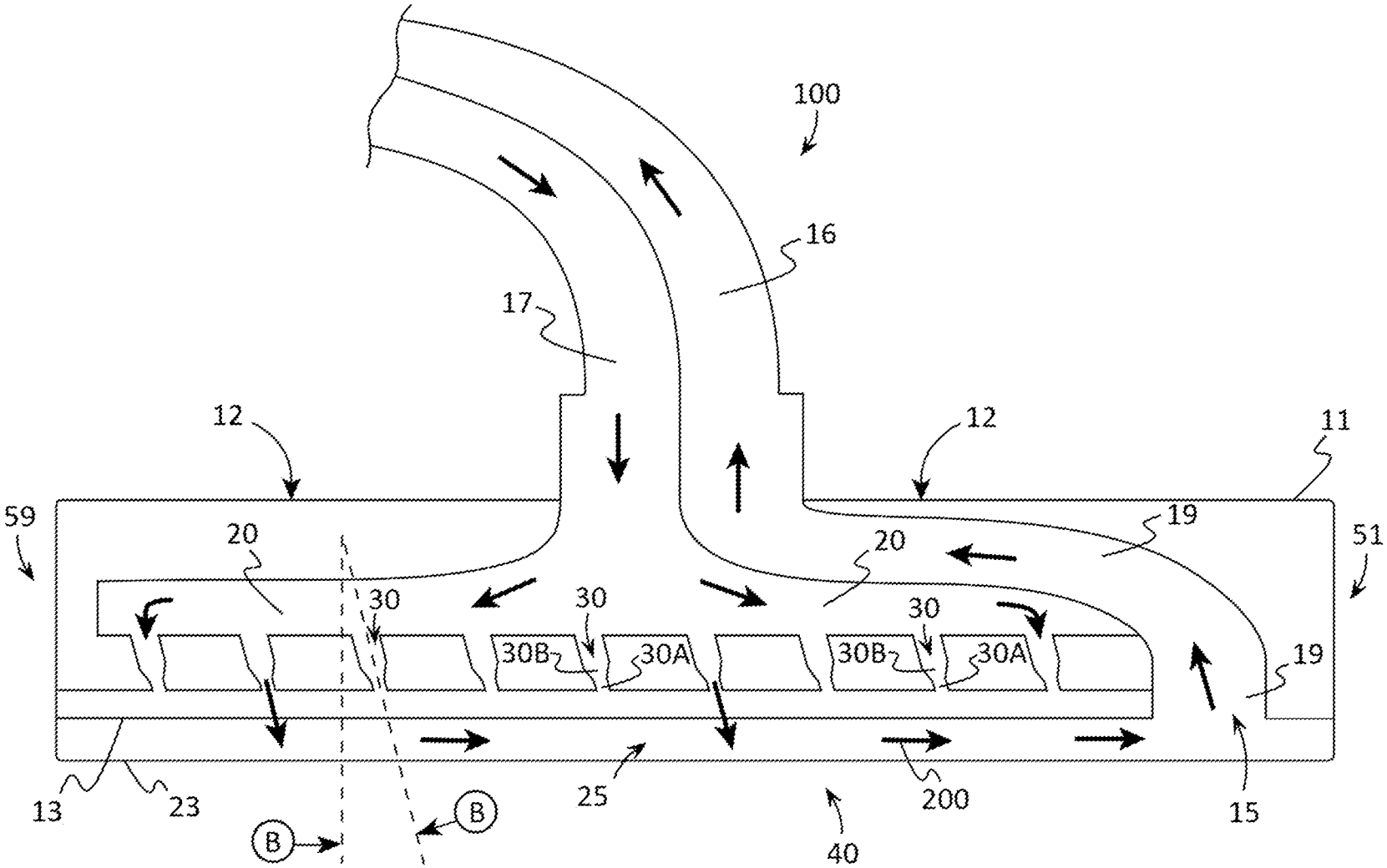
FIG. 4—FIG. 4 depicts a schematic diagram of yet another example of a brushless vacuum device illustrating fluid flow through a first side and first plurality of jets according to various embodiments described herein.
Figure 5:
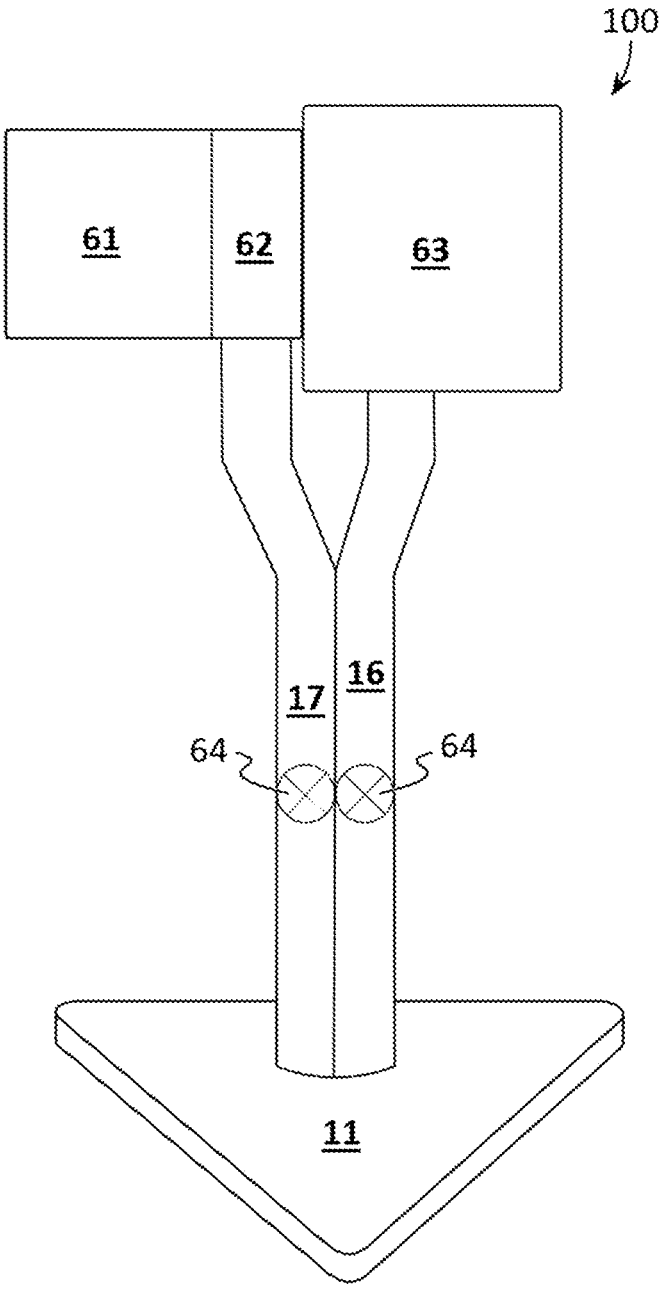
FIG. 5—FIG. 5 illustrates a schematic diagram of still a further example of a brushless vacuum device according to various embodiments described herein.

In some embodiments, the device 100 may comprise a pressure conduit 17 and a suction conduit 16 which may be configured to communicate fluid pressure between an impeller 62 and the vacuum head 11 so as to allow the one or more fluid motivation devices 61 and impellers 62 to be located remotely from the vacuum head 11. A conduit 16, 17, may comprise any type of channel, conduit, opening, or the like, which may be suitable for allowing air to pass from one end of the conduit 16, 17, to the other end. In preferred embodiments, a conduit 16, 17, may comprise a length of flexible tubing, such silicone tubing, latex or other rubber tubing, and flexible polymer tubing, such as vinyl, PTFE tubing, PFA tubing, FEP tubing, PDVF tubing, ETFE tubing, ECTFE tubing, THV tubing, or any other flexible material tubing. In further embodiments, a conduit 16, 17, may comprise a length of generally rigid tubing, such a PVC tubing, polycarbonate tubing, other polymer tubing, aluminum tubing, other metal tubing, or any other generally rigid tubing. In further preferred embodiments, at least a portion of the suction conduit 16 and a portion of the pressure conduit 17 may be coupled together as shown in FIGS. 1, 4, and 5.

In some embodiments, the device 100 may comprise a single fluid motivation device 61, and the suction conduit and pressure conduit may be in communication the fluid motivation device 61 so that the fluid motivation device 61 operates one or more impellers 62 to generate negative air or other fluid pressure in the suction conduit 16 and positive air or other fluid pressure in the pressure conduit 17. In further embodiments, the device 100 may comprise a single fluid motivation device 61, and the suction conduit and pressure conduit may be in communication the fluid motivation device 61 so that the fluid motivation device 61 operates one or more impellers 62 to motivate air through the suction conduit 16 to be recirculated through the first plurality 31 and second plurality 32 of jets by first motivating the air through a filter device 63. In preferred embodiments, a pressure conduit 17 and a suction conduit 16 may be removably coupled to a vacuum head 11 and to other attachments that may utilize positive and negative pressure that may be generated by one or more fluid motivation devices 61 and impellers 62 and which may be supplied by the conduits 16, 17.

In some embodiments, the device 100 may comprise one or more valves 64 which may be operable to control the amount of negative air pressure in the suction aperture 15 and/or the amount of positive air pressure in one or more of the jets 30 of the first plurality 31 and/or second plurality of jets 32. For example, a valve 64 may be configured to allow various amounts of air to enter a suction conduit 16 and/or pressure conduit 17 so that the air may bypass the impeller (s) 62. In preferred embodiments, the device 100 may comprise one or more valves 64 which may be operable to allow the suction and blowing to independently controlled. For example, if a user is cleaning next to a wall they may want a stronger blast of positive pressure from the jets 30 to get into the crack next to the wall. In other embodiments, the device 100 may comprise one or more switches, buttons, control knobs, or other user inputs which may be configured to control the amount of negative air pressure in the suction aperture 15 and/or the amount of positive air pressure in one or more of the jets 30 of the first plurality 31 and/or second plurality of jets 32.

Figure 6:
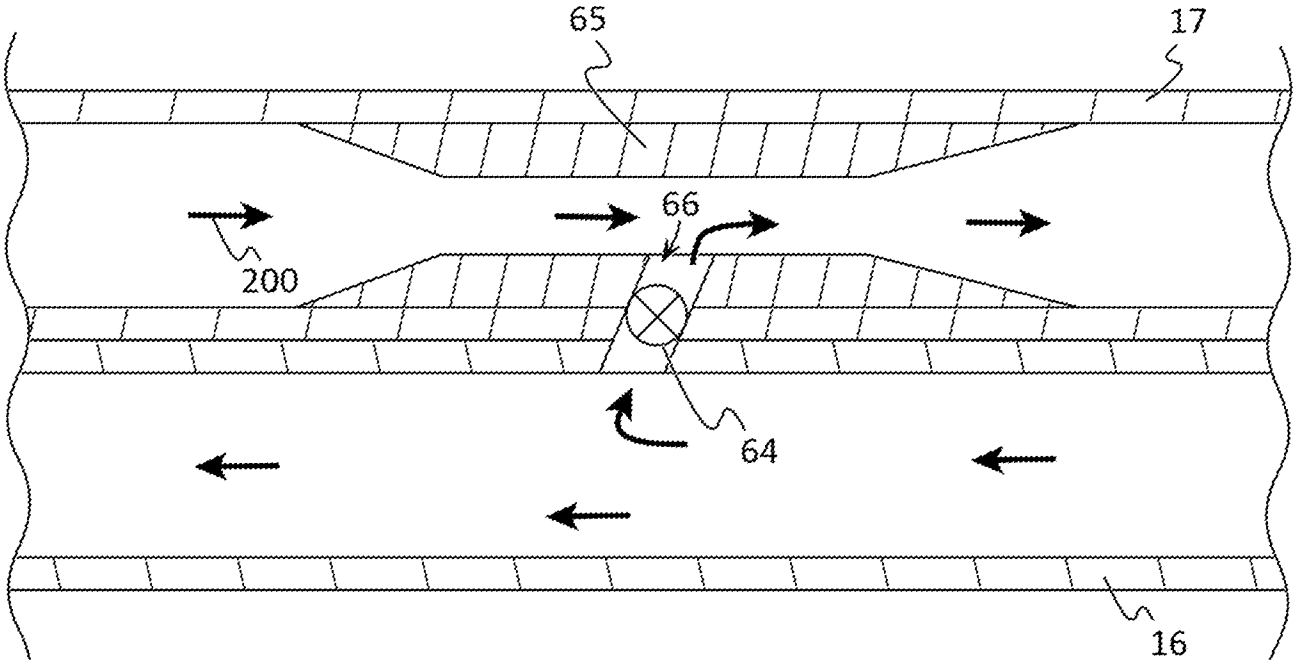
FIG. 6—FIG. 6 depicts a sectional view of a portion of an example suction conduit and pressure conduit having a valve that may be configured to enable, disable, and modulate fluid communication between the suction conduit and a pressure conduit according to various embodiments described herein.

In some embodiments, and as shown in FIG. 6, the device 100 may comprise one or more valves 64 which may be configured to enable, disable, and modulate fluid communication between a suction conduit 16 and a pressure conduit 17. A pressure conduit 17 may comprise a conduit constriction 65 that may narrow or constrict portions of the pressure conduit 17. A passage 66 may be formed in the conduit constriction 65 that may extend through the suction conduit 16 and pressure conduit 17. A valve 64 may enable, disable, and modulate fluid communication through the passage 66 between the suction conduit 16 and pressure conduit 17. The conduit constriction 65 may generate a venturi in the pressure conduit 17 and by opening the valve 64, the venturi may suck fluid (fluid direction shown by arrows 200) from the suction conduit 16 thereby increasing the suction or negative pressure provided by the suction conduit 16 while reducing the blowing or positive pressure provided by the pressure conduit 17. By modulating this valve 64, a user may control the suction and blowing provided at the bottom side 40 of a vacuum head 11.

While some exemplary shapes and sizes have been provided for elements of the device 100, it should be understood to one of ordinary skill in the art that the vacuum head 11, suction conduit 16, pressure conduit 17, channels 25, 26, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, such as which may be used to form bumpers or other energy absorbing structures to prevent damage from impacts between a vacuum head 11 and other objects, such as furniture, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A brushless vacuum device, the device comprising:

a vacuum head having a top surface and an opposing bottom side, a first exterior wall, a second exterior wall, a front end, and a back end, wherein the first exterior wall and second exterior wall are positioned on the bottom side and are coupled together at the front end;

a suction aperture disposed in the vacuum head on the bottom side and positioned proximate to where the first exterior wall and second exterior wall are coupled together;

a first plurality of jets coupled to the vacuum head on the bottom side, the first plurality of jets extending along the first exterior wall between the suction aperture and the back end;

a second plurality of jets coupled to the vacuum head on the bottom side, the second plurality of jets extending along the second exterior wall between the suction aperture and the back end;

a suction conduit coupled to the vacuum head and in communication with the suction aperture, the suction conduit generating negative air pressure in the suction aperture;

a pressure conduit coupled to the vacuum head and in communication with the first plurality and second plurality of jets, the pressure conduit generating a positive air pressure in the first plurality and second plurality of jets;

a fluid motivation device operatively coupled to an impeller, wherein the pressure conduit is configured to directly communicate fluid pressure from the impeller to the first plurality and second plurality of jets;

a first interior wall, wherein the first plurality of jets are positioned in a first channel between the first interior wall and the first exterior wall so that the first plurality of jets are recessed into the vacuum head relative to the first interior wall and the first exterior wall;

a second interior wall, wherein the second plurality of jets are positioned in a second channel between the second interior wall and the second exterior wall so that the second plurality of jets are recessed into the vacuum head relative to the second interior wall and the second exterior wall; and wherein the suction aperture intersects with both the first interior wall and the second interior wall and wherein the suction aperture further intersects with both the first channel and the second channel.

2. The device of claim 1, wherein a portion of the suction conduit and a portion of the pressure conduit are coupled together.

3. The device of claim 1, wherein the suction conduit and pressure conduit are coupled to the top surface and positioned centrally on top surface.

4. The device of claim 1, wherein the first exterior wall and second exterior wall are angled relative to each other between 92 degrees and 30 degrees.

5. The device of claim 1, wherein the suction conduit and pressure conduit are in communication with a single fluid motivation device.

6. The device of claim 1, wherein air that is motivated through the suction conduit is recirculated through the first plurality and second plurality of jets.

7. The device of claim 1, wherein at least one jet of the first plurality of jets is angled towards the suction aperture, and wherein at least one jet of the second plurality of jets is angled towards the suction aperture.

8. The device of claim 1, wherein at least one jet of the first plurality of jets constricts air flowing from the pressure conduit to between the first interior wall and the first exterior wall to generate a first venturi effect, and wherein at least one jet of the second plurality of jets constricts air flowing from the pressure conduit to between the second interior wall and the second exterior wall to generate a second venturi effect.

9. The device of further comprising a cleaning pad coupled to the bottom side of the vacuum head.

10. The device of claim 9, wherein the cleaning pad is removably coupled between the first interior wall and the second interior wall.

11. The device of further comprising a rear wall positioned on the bottom side of the vacuum head, the rear wall coupled to a portion of the first exterior wall that is distal to the front end, and the rear wall also coupled to a portion of the second exterior wall that is most distal to the front end, wherein the rear wall extends linearly from the first exterior wall to the second exterior wall, wherein the rear wall is coupled to a portion of the first interior wall that is most distal to the front end, and wherein the rear wall is coupled to a portion of the second interior wall that is most distal to the front end.

12. A brushless vacuum device, the device comprising:

a vacuum head having a top surface and an opposing bottom side, a first exterior wall, a second exterior wall, a front end, and a back end, wherein the first exterior wall and second exterior wall are positioned on the bottom side and are coupled together at the front end;

a suction aperture disposed in the vacuum head on the bottom side and positioned proximate to where the first exterior wall and second exterior wall are coupled together;

a first plurality of jets coupled to the vacuum head on the bottom side, the first plurality of jets extending along the first exterior wall between the suction aperture and the back end;

a second plurality of jets coupled to the vacuum head on the bottom side, the second plurality of jets extending along the second exterior wall between the suction aperture and the back end;

a pressure conduit coupled to the vacuum head and in communication with the first plurality and second plurality of jets, the pressure conduit generating a positive air pressure in the first plurality and second plurality of jets;

a suction conduit coupled to the vacuum head and in communication with the suction aperture, the suction conduit generating negative air pressure in the suction aperture; and a cleaning pad coupled to the bottom side of the vacuum head.

13. The device of claim 12, wherein a portion of the suction conduit and a portion of the pressure conduit are coupled together.

14. The device of claim 12, wherein the suction conduit and pressure conduit are coupled to the top surface and positioned centrally on top surface.

15. The device of claim 12, wherein the first exterior wall and second exterior wall are angled relative to each other between 92 degrees and 30 degrees.

16. The device of claim 12, wherein the suction conduit and pressure conduit are in communication with a single fluid motivation device.

17. The device of claim 12, wherein air that is motivated through the suction conduit is recirculated through the first plurality and second plurality of jets.

18. The device of claim 12, wherein at least one jet of the first plurality of jets is angled towards the suction aperture, and wherein at least one jet of the second plurality of jets is angled towards the suction aperture.

19. The device of claim 12, wherein the cleaning pad is removably coupled between the first interior wall and the second interior wall.

* * * * *